US005443175A

United States Patent [19]

Kelly et al.

[11] Patent Number: 5,443,175

[45] Date of Patent: Aug. 22, 1995

[54] RESEALABLE CLOSURE DEVICE

[75] Inventors: Ronald L. Kelly, Chester; Mike Price, Mechanicsville, both of Va.

[73] Assignee: Crown Cork & Seal Company, Inc., Philadelphia, Pa.

[21] Appl. No.: 229,828

[22] Filed: Apr. 19, 1994

[51] Int. Cl.[6] ..... B65D 41/06

[52] U.S. Cl. ..... 220/298; 220/212.5; 220/231; 220/269; 220/301; 220/303; 220/316; 220/375; 220/366.1

[58] Field of Search ..... 220/203, 206, 208, 212.5, 220/231, 266, 268, 269, 281, 293, 295, 298, 299, 300, 301, 303, 304, 316, 366, 375; 215/214, 220, 222, 253, 296, 306, 330, 331, 356, 357

[56] References Cited

U.S. PATENT DOCUMENTS

| | | | |
|---|---|---|---|
| 2,513,458 | 7/1950 | Dion . | |
| 2,623,657 | 12/1952 | De Vries | 220/298 |
| 3,031,111 | 4/1962 | Stull | 220/375 X |
| 3,931,891 | 1/1976 | Peppler | 220/298 X |
| 4,023,703 | 5/1977 | Strobe et al. | 220/268 |
| 4,344,545 | 8/1982 | Aschberger et al. . | |
| 4,444,327 | 4/1984 | Hedgewick | 215/222 X |
| 4,462,504 | 7/1984 | Roth et al. . | |
| 4,632,271 | 12/1986 | Taylor et al. . | |
| 4,720,022 | 1/1988 | Gomes . | |
| 4,969,574 | 11/1990 | Shastal | 220/269 |
| 5,135,124 | 8/1992 | Wobser . | |

FOREIGN PATENT DOCUMENTS 7737978 3/1978 Germany .

*Primary Examiner*—Allan N. Shoap
*Assistant Examiner*—Stephen Cronin
*Attorney, Agent, or Firm*—Woodcock, Washburn, Kurtz, Mackiewicz & Norris

[57] ABSTRACT

A can closure includes a plastic insert permanently installed in a hole in the can top, and a plug which seats in a pouring aperture extending through the insert. Locking dogs on both the insert and the plug provide a bayonet-type connection so that the container can be resealed after its contents have been partially used. Protrusions on the locking dogs prevent the plug from being fully removed until pressure within the container has been relieved.

3 Claims, 4 Drawing Sheets

FIG. 1
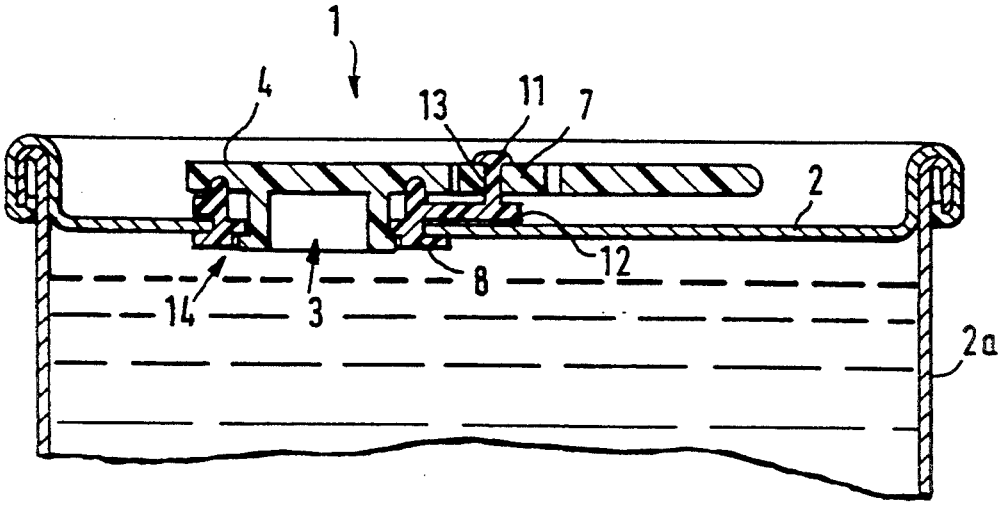
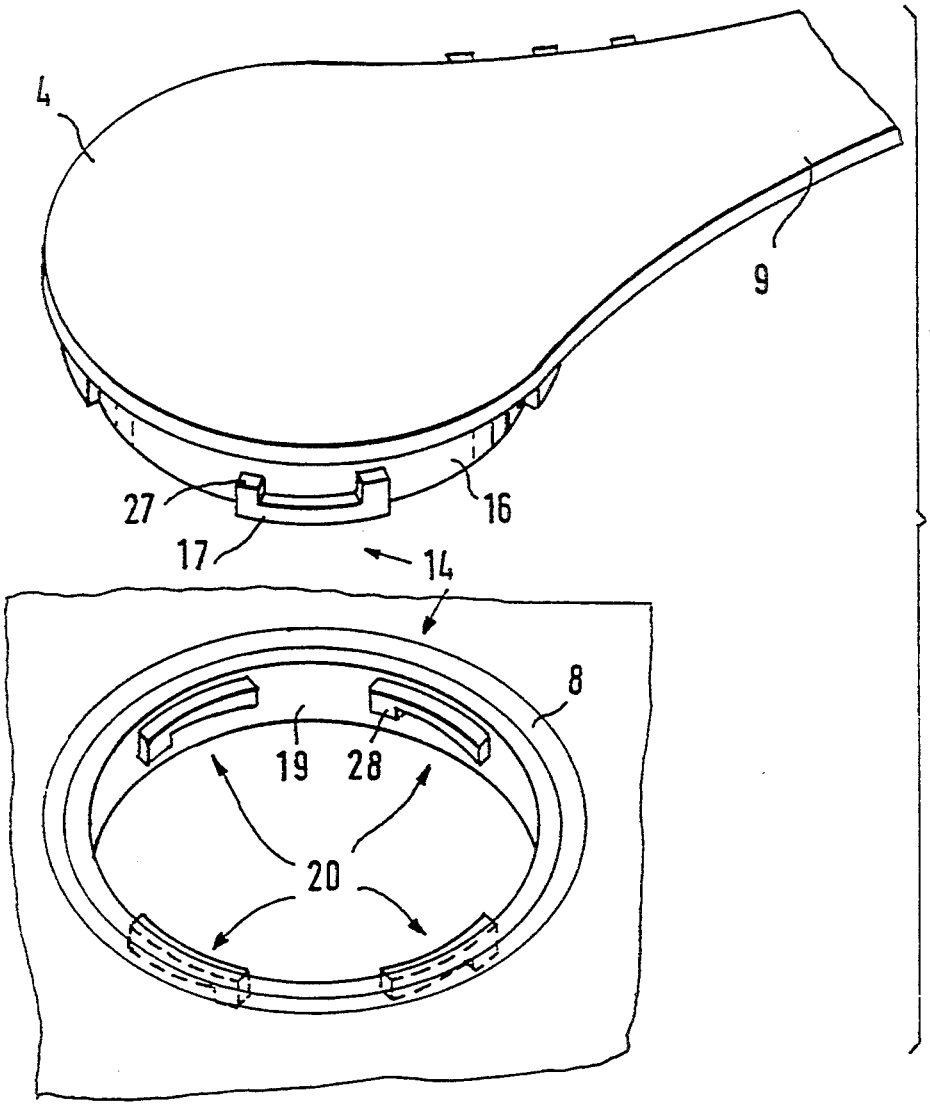
FIG. 2

RESEALABLE CLOSURE DEVICE

BACKGROUND TO THE INVENTION

Resealable closures are known in various forms for most types of containers. For example, plastic or metal closures are widely used for bottles or threaded jars. However, no resealable closures have until now proven practicable for beverage cans. Their user friendliness is thus restricted, and the can side is limited in practice to that of a single serving.

SUMMARY OF THE INVENTION

An object of the invention is to avoid the known disadvantages, and in particular to create a closure device which ensures reliable sealing engagement and which guarantees that the closure will not be forced open by gas pressure when carbonated beverages are involved.

Another object is to relieve carbonation pressure within the container before the cap can be completely removed.

A further object of the invention is to reduce progressively the pressing or closing force of the closure as its sealing parts are pressed together.

These and other objects are attained by a closure assembly embodying the invention. The assembly comprises a closure element having a cylindrical plug portion which is normally situated within a pouring aperture of a fitting on the top of the can. A plurality of circumferentially spaced locking elements or dogs are arranged around the plug element, extending radially outward from the plug element. Each of these dogs has a bearing surface running approximately In an annular plane, outside of the plug element.

The pouring aperture preferably extends through a plastic insert installed in the can top. It is defined by a cylindrical wall portion which protrudes into the can and is so arranged and dimensioned that it accommodates the plug element. Dogs are also provided on the cylindrical wall, arranged at a distance from one another. These dogs protrude inwardly, and each has a bearing surface.

The bearing surfaces of the dogs on the plastic insert and the plug element, respectively, have complementary shapes, 50 as the plug is twisted, the dogs engage each other in pairs, thus making a bayonet type connection between the plug and the insert. One or both of the bearing surfaces of each pair of dogs is slightly inclined relative to a horizontal plane, so that as the closure is twisted closed, bearing forces between the dogs' bearing surfaces.

At least one pair of the closure elements have interlocking means which engage whenever the closure element is forced away from the plastic insert by internal pressure within the can. In this way, opening is prevented as long 60 there is internal pressure. The interlocking means disengage only after pressure has been relieved, when the closure element can be pressed into the plastic insert.

A protrusion is preferably provided on each bearing surface of each dogs this form of the invention is simple to manufacture. Alternatively, the interlocking means may comprise a recess provided in one bearing surface, and a protrusion on the complementary opposed bearing surface.

BRIEF DESCRIPTION OF THE DRAWINGS

The invention is more closely explained in the following embodiments and with the aid of the drawings, wherein;

FIG. 1 is a schematic cross-sectional drawing of a can end with the features of the invention, FIG. 2 shows the closure element and the pouring aperture according to figure in an enlarged scale and in cross section.

DESCRIPTION OF THE PREFERRED EMBODIMENT

Figure 3:
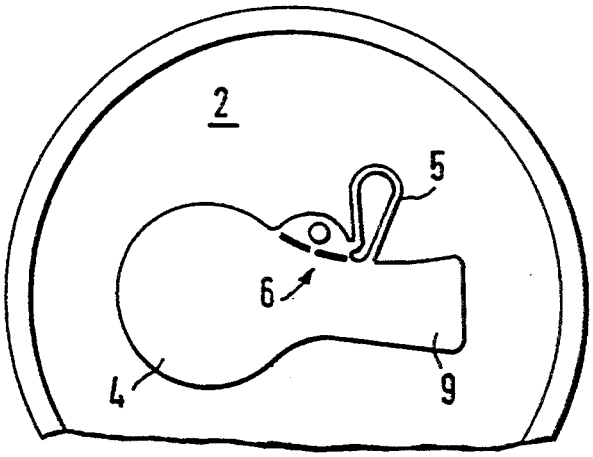
FIGS. 3 to 5 are plan views of a can end according to FIG. 1, showing the closure element in various phases of opening and closing.

According to FIGS. 1–5, a closure assembly 1 is provided on the top end 2 of a can 2*a*. The closure assembly 1 comprises a closure element 4 and a plastic insert 8 having a pouring aperture 3. The closure is normally retained in the aperture by a bayonet type connection 14. In place of the plastic insert 8, a metal fitting or a suitable deformation of the can top 2 can be provided for receiving the closure element 4.

Figure 4:
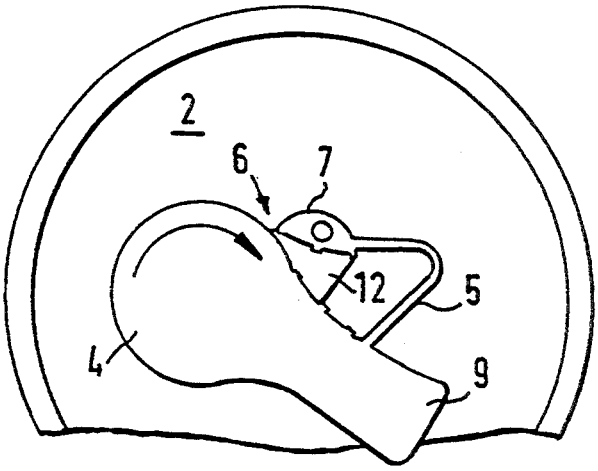
Figure 5:
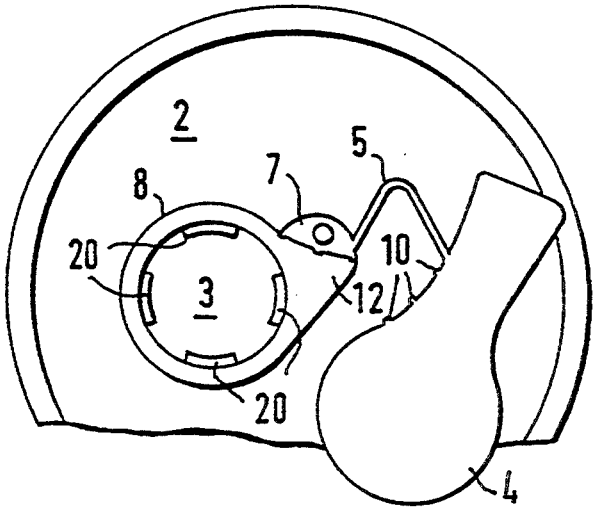
Figure 6:
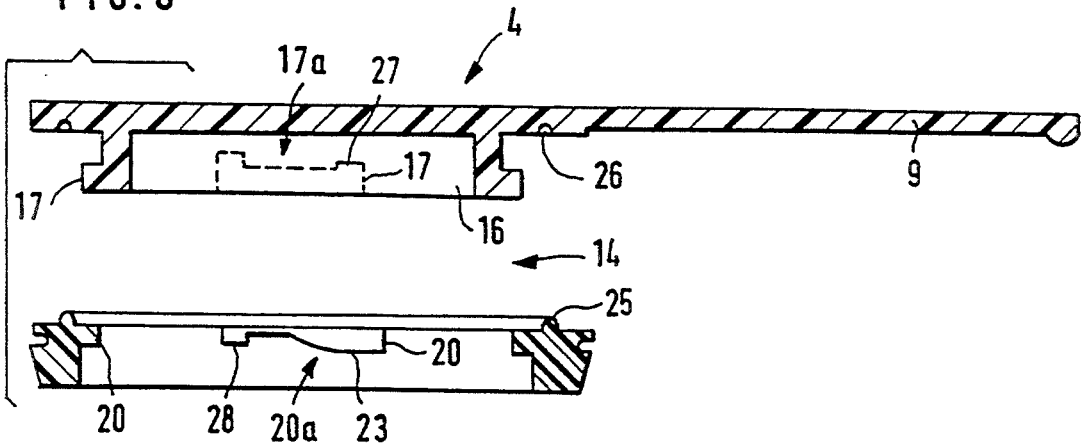
FIGS. 6–10 are schematic representations of a closure device "according to FIG. 1 in cross section, likewise in various phases of opening and closing.
Figure 7:
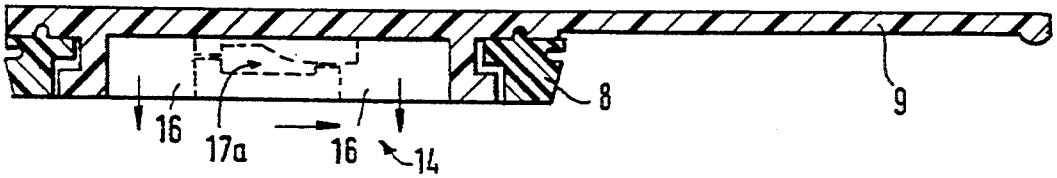

In the embodiment of FIGS. 3 to 5, an anchor 7 is initially Joined to the closure element 4 by three frangible bridges 10 separated by perforations. The anchor 7 is fastened firmly on an extension 12 of the plastic insert 8 by means of the pin 11 (FIG. 1). The pin 11 extends through a hole 13 in the anchor 7 and is flattened at its upper end by heating so that the anchor 7 is permanently connected to the plastic insert 8.

A lever arm 9 provided on the closure element 4 facilitates opening and closing of the closure element 4. In order to open the container, the lever arm 9 is grasped and rotated in the clockwise direction. As shown in FIG. 4, first of all the bridges 10 are ruptured, providing a visible indication that the container has been opened. Then, after being rotated approximately 35 degrees, the bayonet type connection disengages and the closure element 4 can be removed from the aperture. Thereafter, as shown by FIG. 5, the closure element 4 remains tethered to the anchor 7 and thus to the can end 2.

Preferably, the plastic insert 8 and the extension 12 are formed as a single piece injection molded component. The closure element 4, the connecting member 5 and the anchor 7 are likewise manufactured as a single piece by the injection molding method.

The plastic insert 8 can be inserted into the can end and then closed by the closure element 4. Alternatively, it is possible for the plastic insert 8 and the closure element 4 to be preassembled and later jointly affixed in the can end 2.

As can mainly be seen from FIGS. 2 and 6–10, a cylindrical plug element 16 is provided on the closure element 4. This plug element protrudes into the aperture defined by the cylindrical wall portion 19 of the plastic insert 8. Four dogs 17 are provided on the plug element 16, and four complementary dogs 20 are formed on the plastic insert 8, protruding inwardly from the cylindrical wall portion 19. The elements 17 and 20 form a bayonet type connection 14.

The dogs 17 and 20 have respective bearing surfaces 17*a* and 20*a*. FIGS. 6 to 12 are diagrams intended mainly to show the function of the dogs 17, 20, without necessarily being true to scale or definitive of the exact arrangement of the dogs 17, 20 on their respective parts.

Each of the bearing surfaces 20a shown in FIGS. 6 to 10 on the cylindrical wall portion 19 has a curved bottom surface 23 which runs slightly oblique to the horizontal. After insertion of the closure element 4, the inclined surface 23 slides over the bearing surface 17a, pulling the plug into the aperture and thereby creating a sealing connection between the sealing rim 25 and the sealing groove 26.

Figure 8:
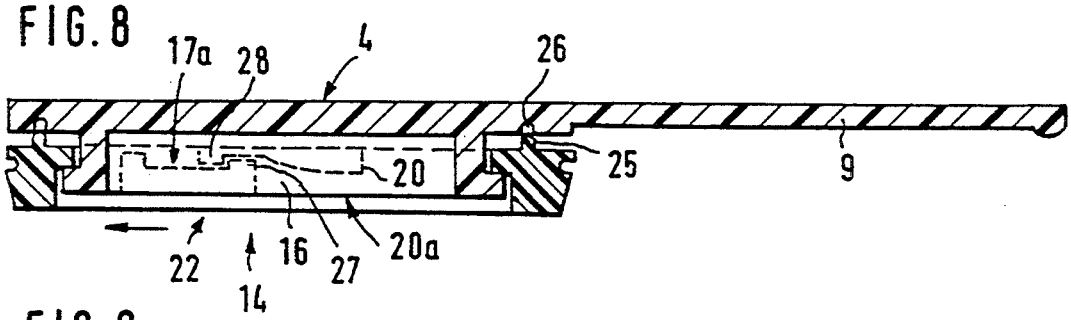
Figure 9:
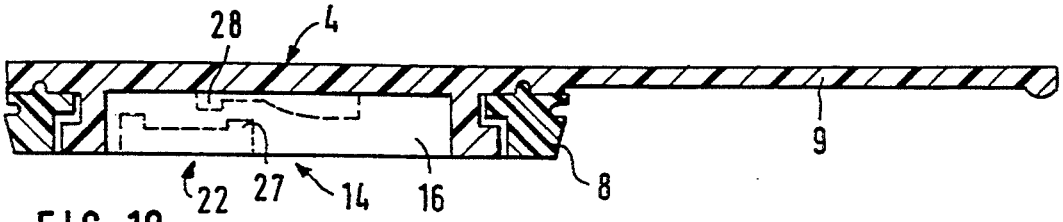
Figure 10:
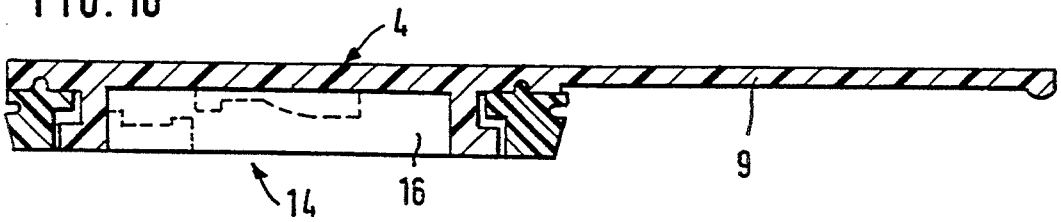

During opening of the closure, in accordance with FIG. 8 the bearing surface 17*a* slides under the inclined surface 23. If, as suggested in FIG. 8, the closure element 4 is pressed upwards by internal pressure within the can, the protrusions 27,28 on the bearing surfaces 17*a*,20*a* respectively will strike one another so that further rotation of the closure element 4 is impossible, as can be seen in FIG. 8. The protrusions 27,28 therefore together constitute an interlocking means 22 which prevents complete opening of the closure element 4 as long as internal pressure exists within the can and the closure element is accordingly pressed upwards.

In the position illustrated in FIG. 8, the sealing rim 25 and the sealing groove 26 are out of engagement so that the internal pressure within the can is able to escape.

As soon as the internal pressure has sufficiently lowered, the closure element 4 can be pushed into the plastic insert sufficiently far that the protrusions 27,28 disengage. The position shown in FIGS. 8 and 9 corresponds to the position in FIG. 4, while the position according to FIG. 7 corresponds to the position in FIG. 3.

Once the interlocking means 22 has disengaged, the closure element 4 can be further rotated, whereupon the bayonet connection 14 is free and the closure element 4 can be removed from the aperture, as shown in FIG. 5.

Figure 11:
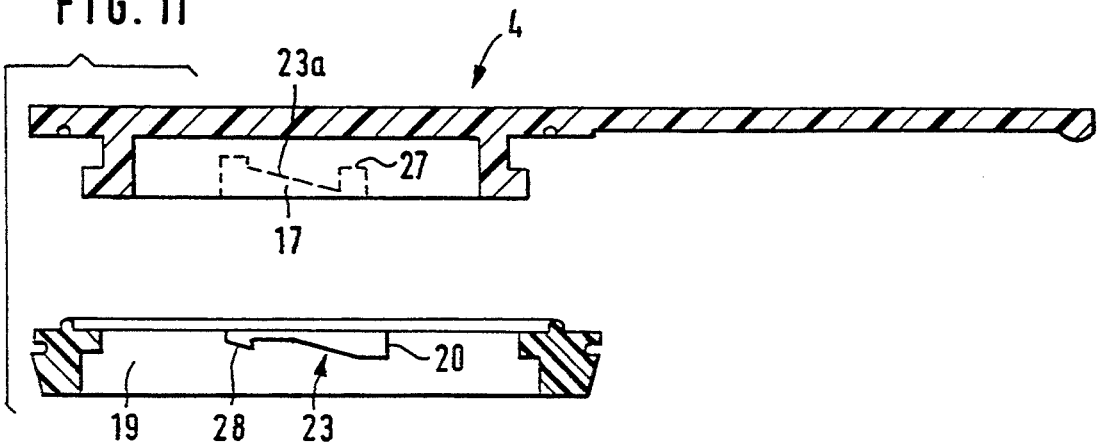
FIG. 11 is a modified embodiment of the invention with double inclined bearing surfaces.

FIG. 11 shows a modified embodiment wherein an inclined surface 23,23*a* is provided both on the dog 17 on the closure element 4 and on the dog 20 on the cylindrical wall portion 19. With this design, the opening or closing rotational travel of the plug is increased.

Figure 12:
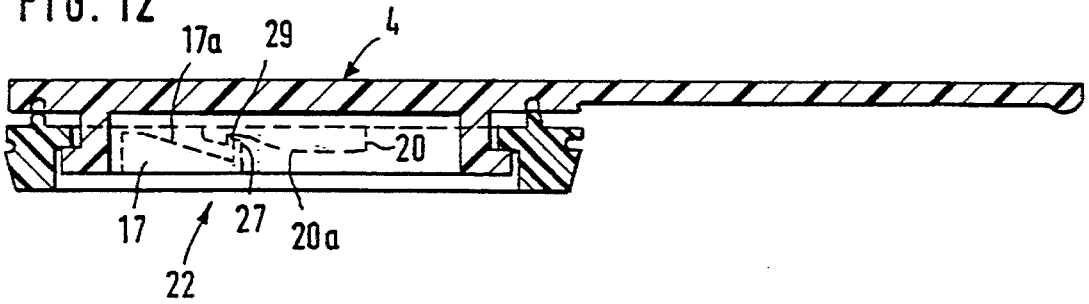
FIG. 12 is a modified embodiment of the invention with modified interlocking means.

FIG. 12 shows another embodiment wherein, as an inter-locking means 22, a protrusion 27 is provided on the dog 17, opposite a recess 29 on the dog 20. When the closure element 4 is opened, the protrusion 27 slides into the recess 29 as the closure element 4 is pressed upwards by internal pressure within the can. Only after pressure is relieved can the connection be completely unscrewed.

Inasmuch as the invention is subject to modifications and variations, the foregoing description and accompanying drawings should not be regarded as limiting the invention, which is de-fined by the following claims and various combinations thereof:

What is claimed is:

1. A plastic closure assembly for a can top comprising a plastic insert to be installed in the can top and defining a pouring aperture; and a closure element fitting in a sealing manner in said aperture, said closure element having a cylindrical plug element extending into the pouring aperture, a plurality of angularly spaced apart dogs projecting radially outwardly from said plug element, each of said dogs having a bearing surface substantially perpendicular to said plug element, said plastic insert having a cylindrical wall portion extending into the can to receive the plug element, a plurality of angularly spaced dogs projecting radially inwardly from said wall portion, each of said dogs having a bearing surface substantially perpendicular to said plug element, the respective bearing surfaces on said plastic insert and the respective bearing surfaces on said plug element being so constructed and arranged to engage in pairs and to form a bayonet type connection, at least one of said bearing surfaces of each pair of dogs being slightly inclined with respect to a plane perpendicular to the longitudinal axis of said plug element, and at least one pair of said bearing surfaces having interlocking means engaging when said closure element is forced away from said insert by pressure in the container so as to prevent disengaging the connection while there is pressure in the container.

2. A plastic closure according to claim 1 wherein said interlocking means comprise a protrusion protruding from each bearing surface of said at least one pair of mating dogs.

3. A plastic closure according to claim 1 wherein said interlocking means comprise a protrusion on the bearing surface of one of said pair of dogs and a mating recess on the other bearing surface of the other of said pair of dogs.

* * * * *